US009475669B2

(12) United States Patent
Schütz et al.

(10) Patent No.: US 9,475,669 B2
(45) Date of Patent: Oct. 25, 2016

(54) CABLE TRANSPORT DEVICE

(71) Applicant: Schleuniger Holding AG, Thun (CH)

(72) Inventors: Peter Schütz, Solinger (DE); Thomas Wortmann, Remscheid (DE)

(73) Assignee: Schleuniger Holding AG, Thun (CH)

( * ) Notice: Subject to any disclaimer, the term of this patent is extended or adjusted under 35 U.S.C. 154(b) by 0 days.

(21) Appl. No.: 14/587,495

(22) Filed: Dec. 31, 2014

(65) Prior Publication Data

US 2015/0115013 A1 Apr. 30, 2015

Related U.S. Application Data

(63) Continuation of application No. 12/990,116, filed as application No. PCT/IB2009/052125 on May 20, 2009, now abandoned.

(60) Provisional application No. 61/117,189, filed on Nov. 23, 2008.

(30) Foreign Application Priority Data

May 20, 2008 (CH) ..... 757/08

(51) Int. Cl.

| | |
|---|---|
| ***B65H 51/10*** | (2006.01) |
| ***B65H 51/32*** | (2006.01) |
| ***B65H 57/04*** | (2006.01) |
| ***H01R 43/052*** | (2006.01) |

(52) U.S. Cl.

CPC ..... *B65H 51/10* (2013.01); *B65H 51/32* (2013.01); *B65H 57/04* (2013.01); *H01R 43/052* (2013.01); *B65H 2404/1421* (2013.01); *B65H 2701/3911* (2013.01)

(58) Field of Classification Search

CPC .... B65H 51/10; B65H 51/105; B65H 51/32; B65H 51/14; B65H 57/04; B65H 57/12; B65H 2404/1421; B65H 2404/144; B65H 2404/1441; H01R 43/052

See application file for complete search history.

(56) References Cited

U.S. PATENT DOCUMENTS

| | | | | |
|---|---|---|---|---|
| 831,729 | A | 9/1906 | Merry | |
| 3,198,220 | A | 8/1965 | Scamberti | |
| 3,540,110 | A | 11/1970 | Schwarz | |
| 3,839,777 | A | 10/1974 | Puzio | |
| 4,095,497 | A | 6/1978 | Radford et al. | |
| 4,272,951 | A | 6/1981 | Vogelsberg | |
| 4,506,566 | A | 3/1985 | Schmid | |
| 4,655,107 | A | 4/1987 | Juergenhake | |
| 4,800,791 | A | 1/1989 | Jürgenhake | |
| 5,010,797 | A | 4/1991 | Stepan | |
| 5,247,732 | A | 9/1993 | Lait et al. | |
| 5,282,717 | A | 2/1994 | Löhr et al. | |
| 5,350,101 | A | 9/1994 | Godlewski | |
| 5,412,855 | A * | 5/1995 | Koch | H01R 43/052 29/33 M |
| 5,497,928 | A | 3/1996 | Burns | |
| 5,601,223 | A * | 2/1997 | Koch | B65H 51/10 226/172 |
| 5,650,181 | A | 7/1997 | Kotaki | |
| 5,758,402 | A | 6/1998 | Asano | |
| 5,784,770 | A | 7/1998 | Long et al. | |
| 5,816,384 | A | 10/1998 | Hsu | |
| 5,820,008 | A | 10/1998 | College | |
| 5,899,373 | A | 5/1999 | Kamei | |
| 5,946,897 | A | 9/1999 | Ichikawa et al. | |
| 5,960,622 | A | 10/1999 | Koch et al. | |
| 6,041,991 | A | 3/2000 | Mehri et al. | |
| 6,135,164 | A | 10/2000 | Celoudoux et al. | |
| 6,167,919 | B1 | 1/2001 | Füchsl et al. | |
| 6,289,944 | B1 | 9/2001 | Frommenwiler | |
| 6,490,785 | B1 | 12/2002 | Kometani | |
| 6,662,987 | B2 | 12/2003 | Erni | |
| 6,948,675 | B2 | 9/2005 | Frommenwiler | |
| 7,240,421 | B2 | 7/2007 | Miyoshi et al. | |
| 7,647,759 | B2 | 1/2010 | Braun et al. | |
| 2005/0050713 | A1 | 3/2005 | Locher et al. | |
| 2005/0097731 | A1 | 5/2005 | Miyoshi | |
| 2011/0049211 | A1 | 3/2011 | Schuetz | |
| 2014/0284368 | A1 | 9/2014 | Wortmann | |
| 2014/0331636 | A1 | 11/2014 | Keil | |
| 2015/0101700 | A1 | 4/2015 | Stier | |
| 2015/0158678 | A1 | 6/2015 | Wortmann | |

FOREIGN PATENT DOCUMENTS

| | | | |
|---|---|---|---|
| CH | 673858 | A5 | 4/1990 |
| CN | 201594421 | U | 9/2010 |
| DE | 3630359 | A1 | 3/1988 |
| DE | 4104597 | A1 | 10/1991 |
| DE | 19624973 | A1 | 1/1998 |
| DE | 19631770 | A1 | 2/1998 |
| DE | 19844416 | A1 | 4/1999 |
| DE | 10107670 | A1 | 9/2002 |
| DE | 102010017981 | A1 | 10/2010 |
| EP | 0303724 | A1 | 2/1989 |
| EP | 0598276 | A1 | 5/1994 |
| EP | 0708050 | A1 | 4/1996 |
| EP | 0788200 | A2 | 8/1997 |
| EP | 0984530 | A1 | 3/2000 |
| EP | 1009074 | A2 | 6/2000 |
| EP | 1032095 | A2 | 8/2000 |
| EP | 1213800 | A1 | 6/2002 |
| EP | 1387449 | A1 | 2/2004 |
| EP | 1447888 | A1 | 4/2004 |
| EP | 0889486 | B1 | 8/2004 |
| EP | 1691457 | A1 | 8/2006 |
| GB | 868532 | A | 5/1961 |
| JP | 2004071237 | A | 3/2004 |
| WO | 93/06320 | A1 | 4/1993 |
| WO | 02/077685 | A1 | 10/2002 |
| WO | 2009141794 | A2 | 11/2009 |
| WO | 2011/055336 | A1 | 5/2011 |
| WO | 2013/068981 | A1 | 5/2013 |
| WO | 2013/068984 | A1 | 5/2013 |
| WO | 2013/068986 | A1 | 5/2013 |
| WO | 2013/068988 | A1 | 5/2013 |
| WO | 2013/068990 | A1 | 5/2013 |
| WO | 2013/068988 | A4 | 7/2013 |

OTHER PUBLICATIONS

Commonly-owned copending U.S. Appl. No. 14/357,248 as U.S. national phase of PCT/IB2012/056307 filed Nov. 9, 2012 (Corresponding WO Publication cited above WO/2013/068988, dated May 16, 2013).

Copending commonly-owned U.S. Appl. No. 14/357,226 entered U.S. national phase May 11, 2014.

International Search Report for corresponding PCT Application No. PCT/ IB2009052125, 6 pages, dated Jul. 15, 2010.

"Gamma 263 Product Brochure" downloaded from "www.komaxgroup" on Feb. 17, 2011, 2 pages, undated.

* cited by examiner

*Primary Examiner* — Michael McCullough

(74) *Attorney, Agent, or Firm* — Timothy X. Gibson, Esq.; Gibson & Dernier LLP

(57) ABSTRACT

A cable transport device having a pivotably mounted cable transporter, a first drive means connected in a stationary manner to a base frame and intended for achieving an exactly defined pivot movement of the cable transporter around a pivot axis and a second drive means for synchronous driving of at least two cooperating pressure rollers. The second drive means with a drive axle for the pressure rollers is connected in a stationary manner to the base frame, and the drive axle of the second drive means coincides with the pivot axis for the cable transporter. In additional versions, the second drive means with a drive axle for the pressure rollers is also connected in a stationary manner to the base frame, and the rollers' axes of rotation are parallel to one another and parallel to a common pitch axis. In these versions, transmission of the drive movement to the toothed belt driving the pressure rollers is effected via a toothed belt which is tensioned symmetrically to the center of rotation of the pivot axis between a first intermediate shaft arranged on a base plate of the cable transporter and a second intermediate shaft fixed to the machine frame, the pitch axis of the cable transporter being identical to the axis of the first intermediate shaft. The cable transport device may be equipped with a guide sleeve that includes a grooved plate and a cover plate that may be replaced for adaptation to different cable diameters and for correction of the cable position.

23 Claims, 11 Drawing Sheets

CABLE TRANSPORT DEVICE

CROSS REFERENCE TO RELATED APPLICATIONS

This application is a continuation of U.S. patent application Ser. No. 12/990,116 which is a 371(c) national-stage entry of PCT International Application No. PCT/IB2009/052125 filed on May 20, 2009, which claims the benefit of priority to prior Swiss national application no. 00757/08 filed on May 20, 2008 and also claims the benefit of priority, and as a non-provisional of, prior U.S. provisional application No. 61/117,189 filed on Nov. 23, 2008; the entire contents of PCT International application no. PCT/IB2009/052125 and U.S. patent application Ser. No. 12/990,116 are incorporated herein by reference.

FIELD OF THE INVENTION

The invention relates to a cable transport device having a pivotably mounted cable transporter for a cable to be drawn in and to be transported, a first drive means connected in a stationary manner to a base frame and intended for achieving an exactly defined pivot movement of the cable transporter about a pivot axis and a second drive means for synchronous driving of at least two cooperating pressure rollers, at least one pressure roller being arranged so as to be laterally adjustable, and a cable transport device having a guide sleeve.

BACKGROUND

Prior Art

Cable transport devices are known, for example from a CrimpCenter of the applicant. Such cable transport devices are fixed in a stationary manner on a base frame. A first gripper is arranged in the cable transport axis on the base frame on a pivot device having a moveable guide carriage, this gripper cooperating with processing stations, for example with a cutting and insulation stripping station arranged in the cable transport axis and with a crimping device arranged outside the cable transport axis. The electric cable is led from a store, for example from a cable drum, through a guide sleeve and two alignment units to a cable transporter. In the cable transporter, the cable is clamped between two coated toothed belts. The toothed belts are each driven by drive and deflection belt sprockets and supported several times by smaller belt sprockets in the region between the drive and deflection belt sprockets. The two toothed belts are pressed by a suitable pressing device, for example pneumatically, with a force against one another so that there is sufficient frictional force between the coated toothed belts and the cable to be transported between the toothed belt coatings. The cable transporter is driven by a controlled servo drive motor. In this way, the clamped cable present between the toothed belts is transported in the longitudinal direction. A measuring wheel of a longitudinal measuring device, which measuring wheel rests with spring force outside the transport system against the cable, detects the required cable length with the aid of an encoder. The signals of this encoder are fed into the control of the servo motor so that the process for cutting the cable to length is controlled in this way.

The cable is led through guide sleeves and a guide tube from the cable transporter into the working region of a cutting and insulation stripping station and is gripped by the first gripper at the cable beginning. The zero cut is now carried out at the cable beginning in the cutting and insulation stripping station and is detected by the measuring wheel. This is followed by the stripping of insulation from the cable beginning. The pivot device then pivots the gripper to the laterally arranged processing stations where, for example, a seal and/or a crimp contact is mounted on the cable end stripped of insulation.

With a cable transport and pivot device according to EP0708050B1, the gripper arranged on a pivot device could be omitted if the cable transport device was mounted on a pivot device. In this way, the distance between the cable transport device and the processing stations was considerably reduced. A disadvantage of this device is, however, the complicated design for force transmission via a plurality of axes of rotation. Another disadvantage is that the drive motor responsible for the cable transport is arranged directly on the pivot device and must be concomitantly swiveled by the drive motor responsible for the pivoting process.

For controlled guidance of the cable to be transported, EP 0 708 050 B1 provides, on the cable feed side, an entry cable guide connected to a flexible guide tube and, on the cable delivery side, an exit cable guide. A guide sleeve in the form of a tube has the disadvantage that it too has to be replaced when changing to a cable having a different cross-section and the cable has to be threaded again. Such a procedure is complicated and considerably increases the changeover times.

SUMMARY OF THE INVENTION

Object of the Invention

It is an object of the invention considerably to simplify the design of a cable transport device having a pivotable cable transporter and in this way to produce said design more economically and nevertheless to ensure the necessary precision for the cable processing.

It is also an object of the present invention to provide a cable transport device having a guide sleeve, which does not have the disadvantages described and can be adapted to the cable according to the cable cross-section to be processed in each case.

Achievement of the Object

This object is achieved by the features disclosed herein. Advantageous further developments are disclosed herein.

According to the invention, the second drive means having a drive axle for the pressure rollers of the cable conveyor is connected in a stationary manner to the base frame, and the drive axle of the second drive means coincides with the pivot axis for the cable transporter.

With such a design of the cable transport device according to the invention, a very great deal of material can be saved. The number of moving parts is reduced and hence also the susceptibility to faults and the required maintenance.

In a second version of the invention, the second drive means having a drive axle for the pressure rollers of the cable conveyor is likewise connected in a stationary manner to the base frame, the axes of rotation are parallel to one another and parallel to a common pitch axis, and the transmission of the drive movement takes place via a toothed belt which is clamped symmetrically relative to the center of rotation of the pivot axis of the first drive means between a first intermediate shaft arranged on a base plate of the cable transporter and a second intermediate shaft fixed to the machine frame, the pitch axis of the cable transporter being identical to the axis of the first intermediate shaft.

A pivotable cable transport device as described herein is also substantially more material- and space-saving than comparable cable devices of the prior art.

According to the invention, the guide sleeve is composed of a grooved plate and a cover plate. These plates can be replaced for adaptation to different cable diameters and for correction of the position of the cable and are equipped for this purpose with different groove geometries.

Such guide sleeves are not limited to pivotable cable transport devices but can also be used in stationary systems.

BRIEF DESCRIPTION OF THE DRAWINGS

A plurality of working examples of the invention are illustrated with reference to FIGS. 1 to 7.

FIG. 5 shows a schematic diagram of the device according to the invention for regulating the pressure for cable draw-in.

DETAILED DESCRIPTION OF THE INVENTION

Figure 1:
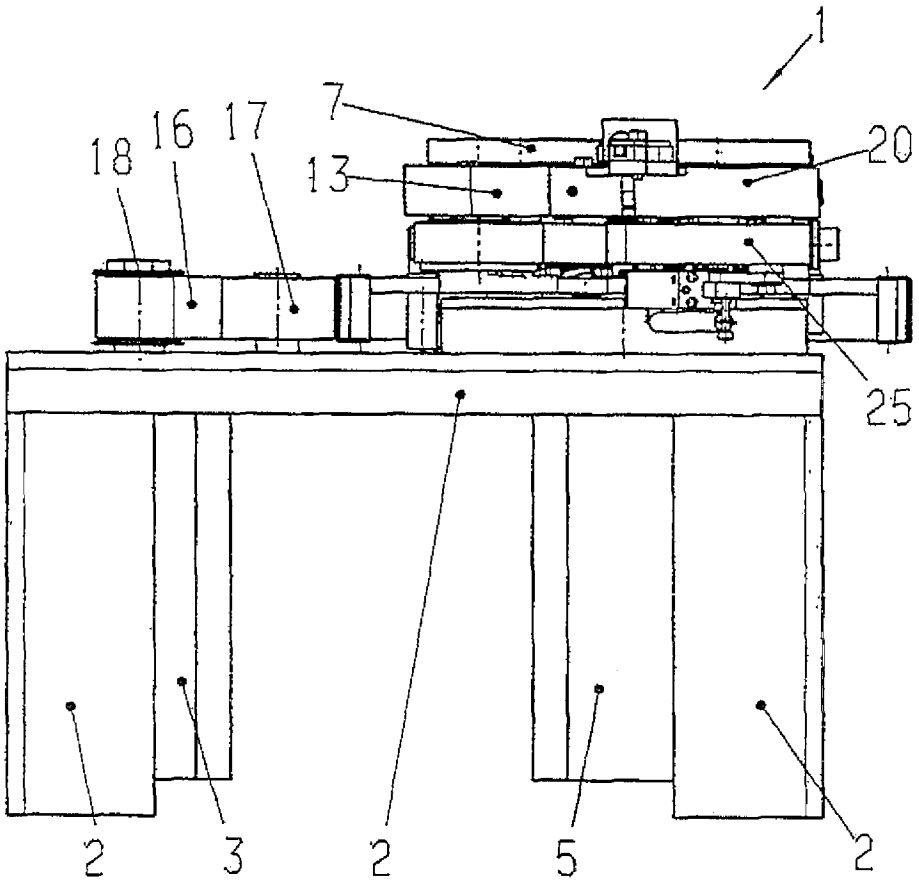
FIG. 1 shows a front view of a cable transport device according to the invention in a first version according to the present disclosure.
Figure 2:
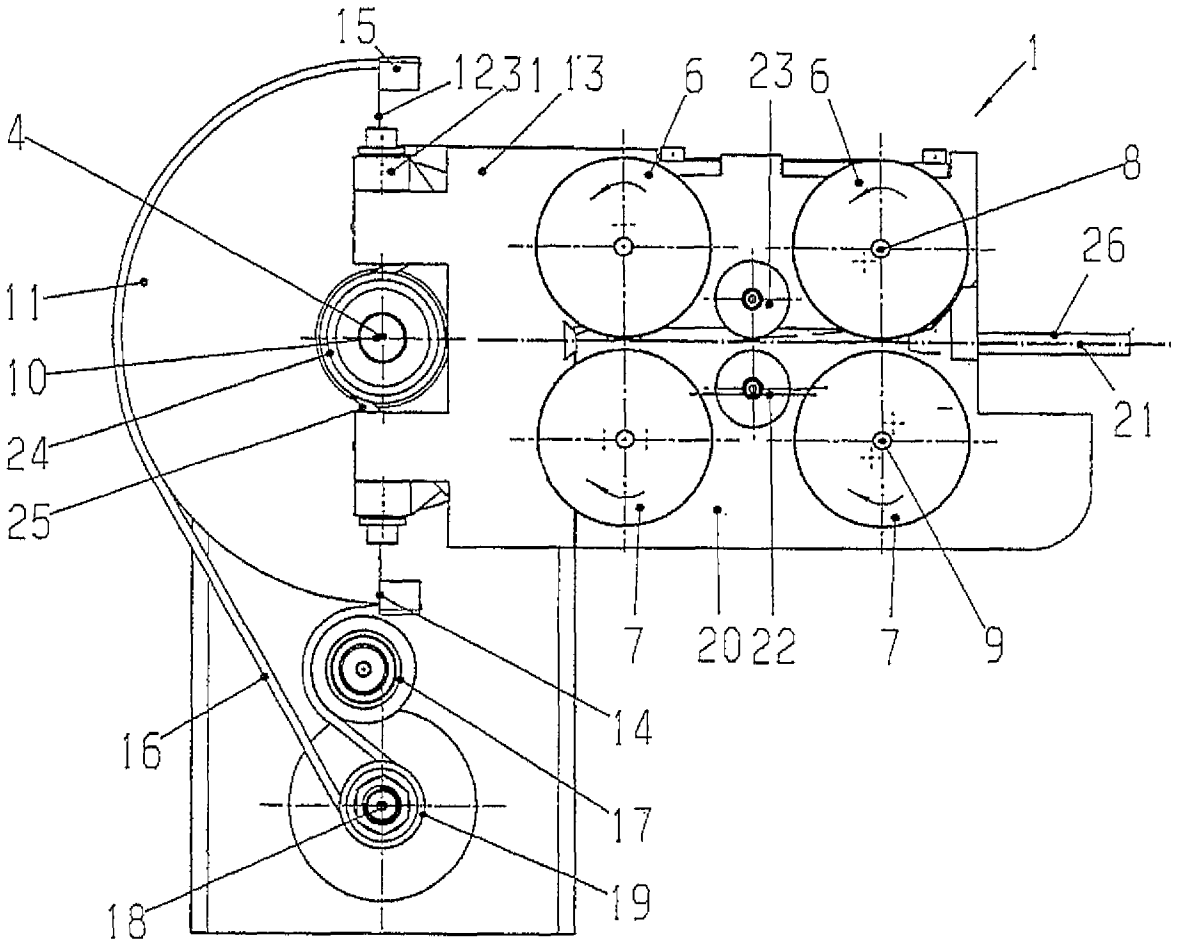
FIG. 2 shows a plan view of FIG. 1 in a 90° pivot position.

The cable transport device according to FIGS. 1, 2, 6 and 11 has a pivotably mounted cable transporter 1 for a cable 21 to be drawn in and to be transported, and a first drive means 3 connected in a stationary manner to a base frame 2 and intended for achieving an exactly defined pivot movement of the cable transporter 1 about a pivot axis 4. A second drive means 5 ensures synchronous driving of two cooperating pressure rollers 6 with two cooperating pressure rollers 7, whose axes 8, 9 of rotation are parallel to one another and parallel to the common pivot axis 4. The two pressure rollers 7 are, as shown in FIG. 2, arranged so as to be laterally adjustable. Drive means 3 and 5 may be connected in a stationary manner to base frame 2 by suitable connecting means such as screws 47 and 48.

According to the invention, the second drive means 5 with its drive axle 10 is connected in a stationary manner to the base frame 2. The drive axle 10 of the second drive means 5 for the pressure rollers 6, 7 of the cable transporter 1, coincides with the pivot axis 4 for the cable transporter 1.

Figure 6:
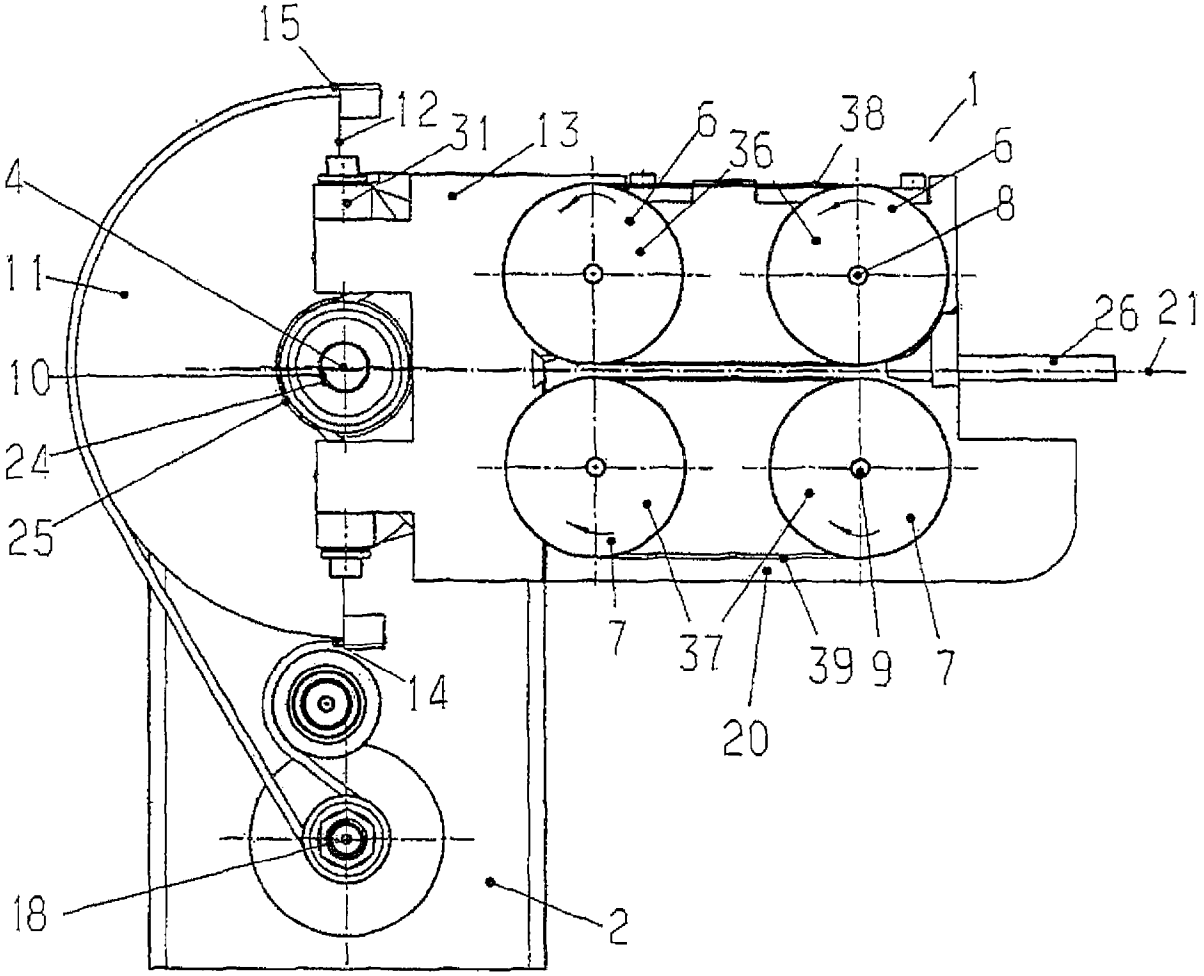
FIG. 6 shows a plan view of FIG. 1 in a 90° pivot position in a further embodiment.

In the embodiments of the invention according to FIGS. 1, 2 and 6, a semicircular pivot plate 11 is mounted horizontally around the pivot axis 4. The semicircular pivot plate 11 is connected via the rotary bearing of the pitch axis 31 to a base plate 13 of the cable transporter 1. In each case one end 14, 15 of a toothed belt 16 is held on the two outsides of the semicircular pivot plate 11 by clamping in a stationary manner, the toothed belt 16 being led directly from its first end 14 via a deflection belt sprocket 17 and a drive belt sprocket 19 mounted on a first drive axle 18 of the drive means 3, via the outer surface of the semicircular pivot plate 11, to the second end 15 of the clamping of the toothed belt 16.

Figure 3:
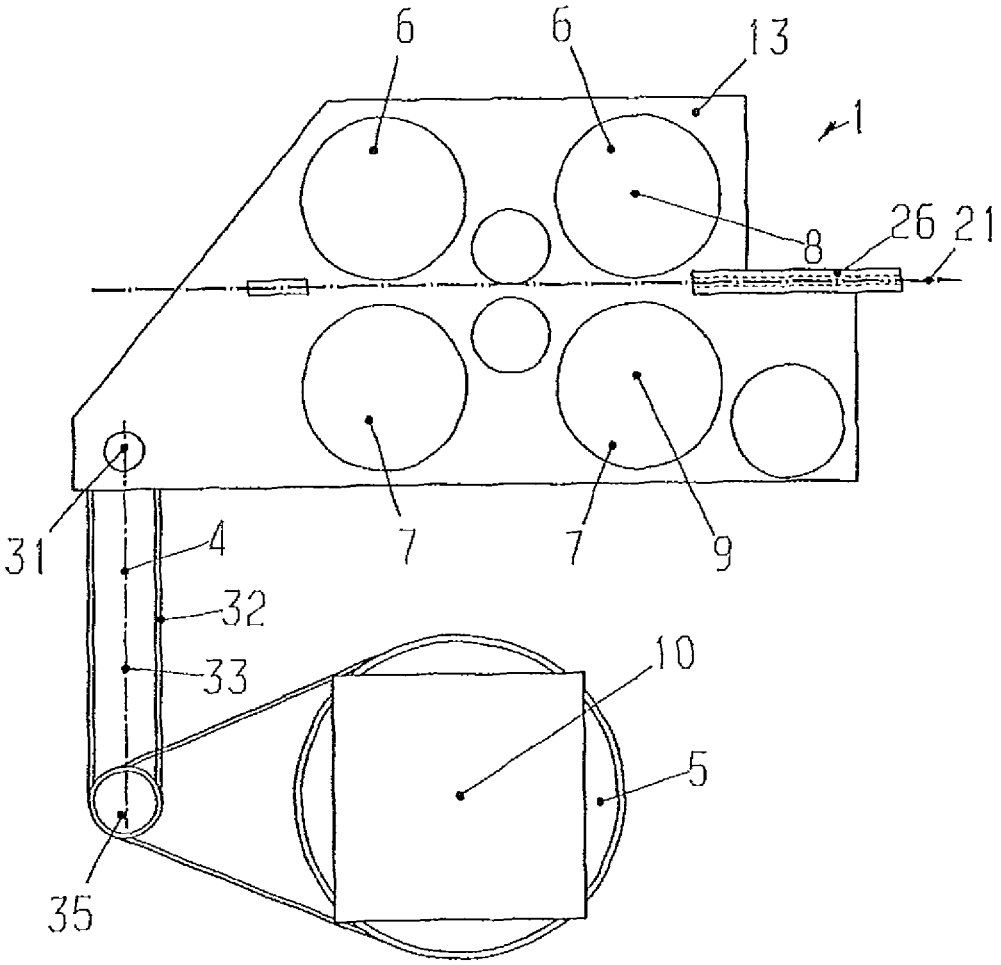
FIG. 3 shows a schematic diagram of a front view of a cable transport device according to the invention in a second version according to the present disclosure in a 90° pivot position.
Figure 4:
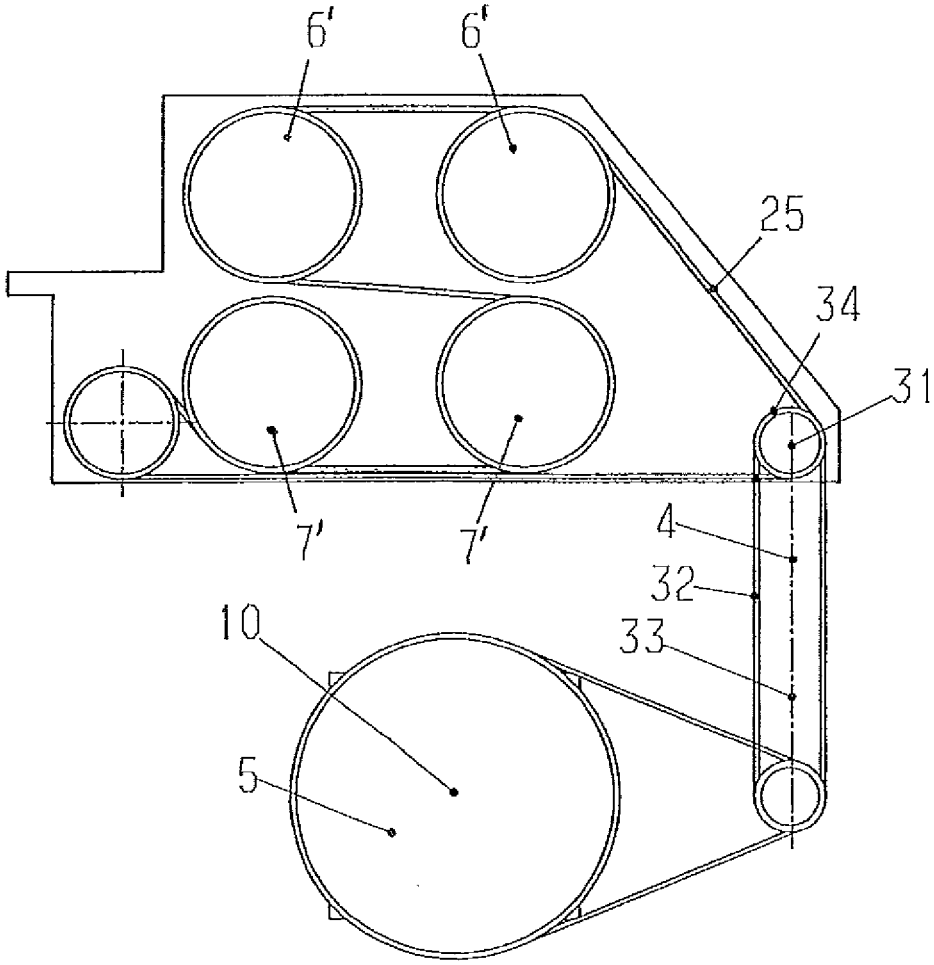
FIG. 4 shows a schematic diagram of a back view of FIG. 3.
Figure 7:
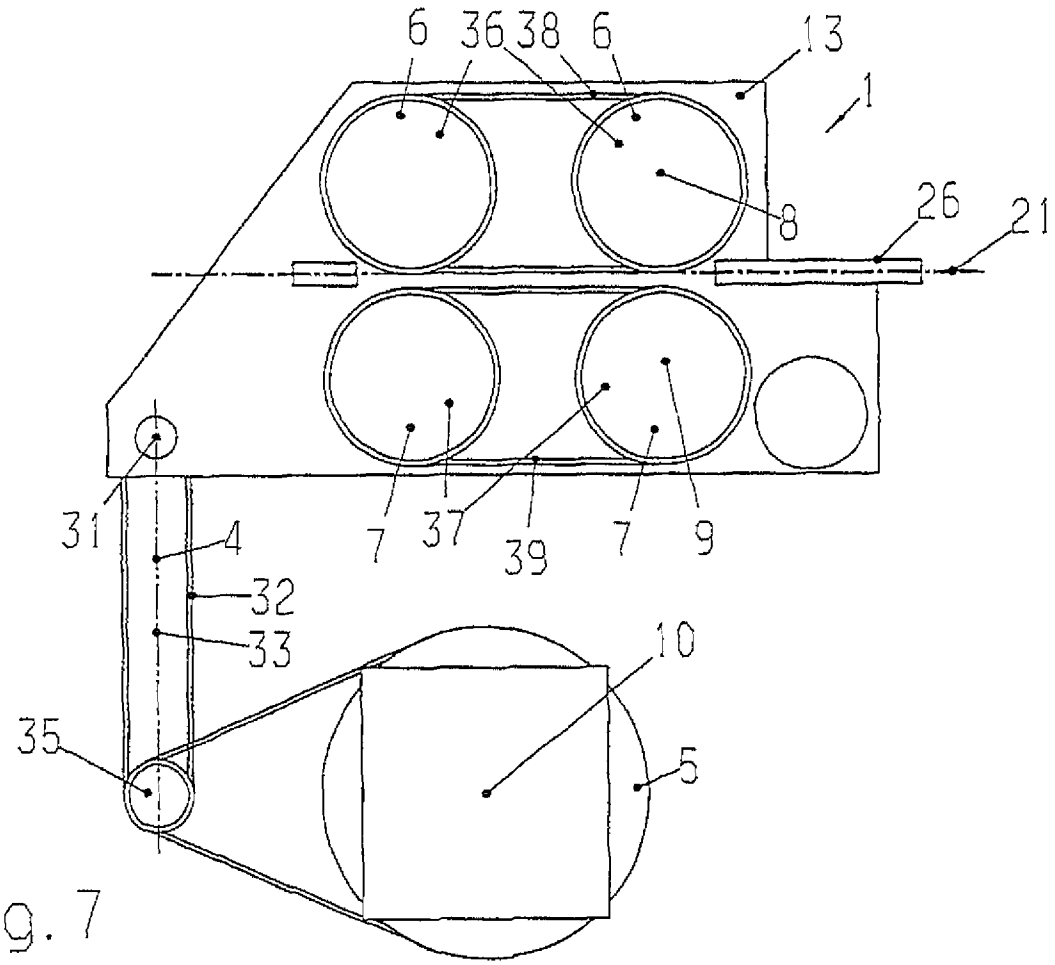
FIG. 7 shows a schematic diagram of a front view similar to FIG. 3 and an embodiment according to FIG. 6.

The cable transport device shown in FIGS. 3, 4 and 7 likewise has a pivotably mounted cable transporter 1 for a cable 21 to be drawn in and to be transported and a first drive means 3 connected in a stationary manner to the base frame 2 and intended for achieving an exactly defined pivot movement of the cable transporter 1 around the pivot axis 4. In these embodiments, too, the cable transport device has a second drive means 5 for synchronous driving of at least two cooperating pressure rollers 6, 7, whose axes 8, 9 of rotation are parallel to one another and perpendicular to the common pivot axis 4. Readers will understand from FIGS. 3-4,7 that as they are schematic, they do not show the details of the pivot unit, first drive motor, and transmission-to-drive for the pivot movement about pivot axis 4, but that these may be readily understood from FIGS. 1-2, 6 of the drawings to be essentially similar. Moreover, two pressure rollers 7 are arranged in a laterally adjustable manner, although the adjustability is not explicitly shown in the schematic diagrams according to FIGS. 3, 4 and 7.

While FIG. 3 shows the front view of the schematic diagram of the cable transport device with four pressure rollers 6, 7, the back view of FIG. 3 is shown in FIG. 4. According to the invention, according to FIGS. 3 and 4, the second drive means 5 is likewise connected with a drive axle 10 for the pressure rollers 6, 7 of the cable transporter 1 in a stationary manner to the base frame 2. While in the embodiments according to FIGS. 1, 2 and 6 the base plate 13 is arranged horizontally, the base plate 13 in the embodiments according to FIGS. 3, 4 and 7 is oriented vertically. The axes 8, 9 of rotation are parallel to one another and parallel to a common pitch axis 31. As explained in the immediately preceding paragraph, and as depicted within FIGS. 3-4, 7 the transmission of the drive movement to the toothed belt 25 and thus to the four rollers 6,7 of the cable transport device takes place via a toothed belt 32, which is clamped symmetrically to the center 33 of rotation of the pivot axis 4 of the first drive means between a first intermediate shaft 34 arranged on a base plate 13 of the cable transporter 1 and a second intermediate shaft 35 fixed to the machine frame. The pitch axis 31 of the cable transporter 1 is identical to the axis of the first intermediate shaft 34.

In order to control the pressure on the cable 21 to be transported, an adjustable plate 20 according to FIG. 2 is mounted so as to be transversely displaceable relative to the base plate 13 of the cable transporter 1 for the purpose of adjusting the pressure. Pressure rollers 6 rotating counterclockwise are arranged on the base plate 13 and pressure rollers 7 rotating clockwise are arranged on the adjustable plate 20, or vice versa.

As further shown in FIG. 2, two pressure rollers 6 are rotatably mounted on one axis 8 of rotation each on the base plate 13 of the cable transporter 1 and likewise two pressure rollers are rotatably mounted on one axis 9 each on the adjustable plate 20, the respective axes 8, 9 of rotation of the pressure rollers 6, 7 being arranged opposite one another. A measuring wheel 22 for measuring the required cable length is located between two pressure rollers 7, and a counter-wheel 23 is arranged between two pressure rollers 6, or vice versa, directly against the cable 21 transported.

Belt sprockets (6', 7') which have a drive connection via a double-sided toothed belt 25 to a second drive sprocket arranged on the drive axle 10 of the second drive means 5 are arranged on the axes 8, 9 of rotation of the pressure rollers 6, 7, on the underside of the cable transporter 1 (FIG. 4), the toothed belt 25 transmitting the rotation of the drive belt sprocket 24 to the pressure rollers 7 arranged on the adjustable plate 20. The toothed belt 25 between the belt sprockets (6') of the pressure rollers 6 and the belt sprockets (7') of the pressure roller 7 is clamped diagonally, resulting in the counterclockwise movement of the pressure rollers 6 and the clockwise movement of the pressure rollers 7.

The base plate 13 of the cable transporter 1 can, according to FIG. 2, be mounted together with the adjustable plate 20 on the drive axle 10 or, according to FIG. 3, on the pitch axis 31 so as to be pivotable together.

Figure 5:
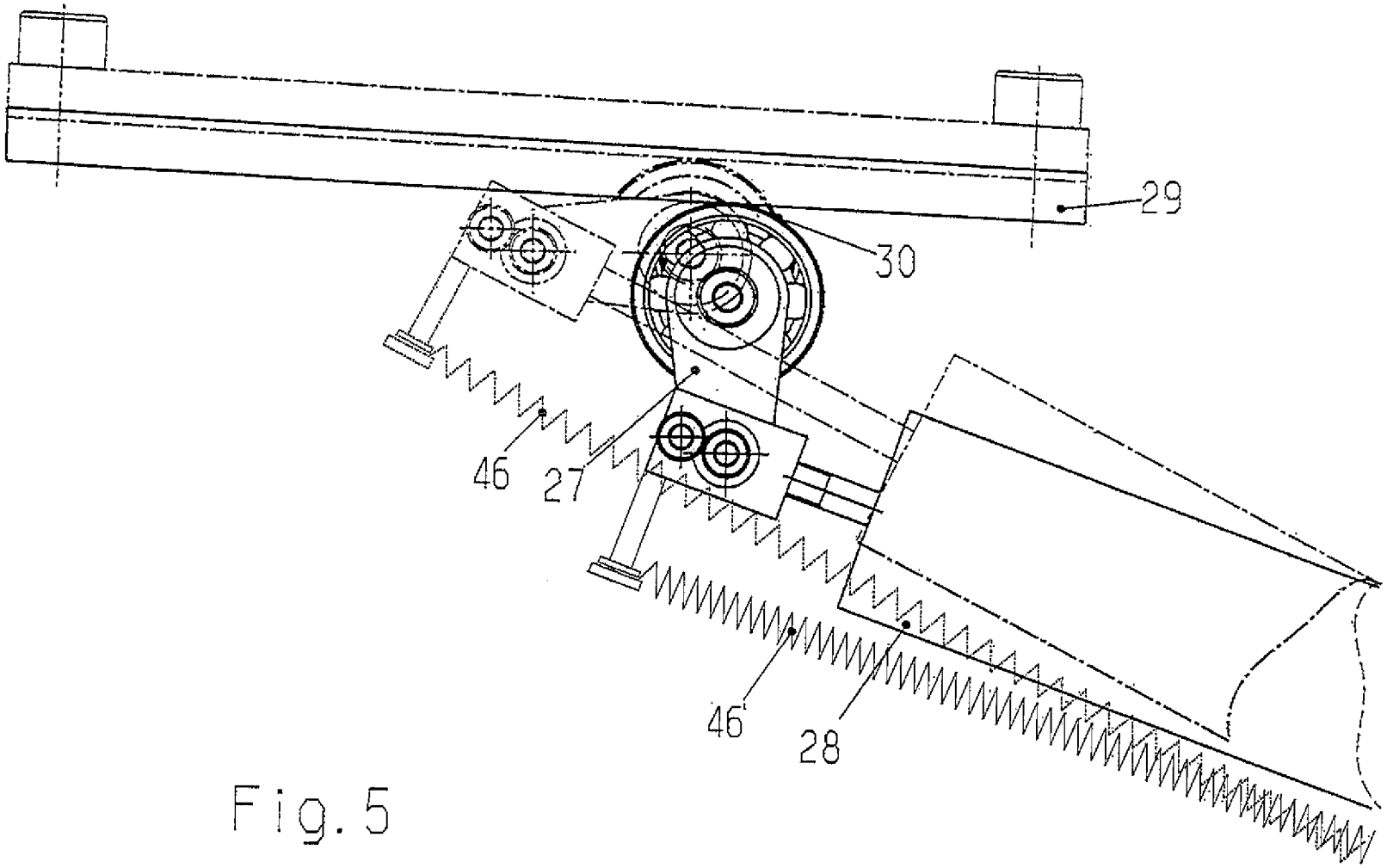

For the purpose of inserting the cable 21 to be transported, the adjustable plate 20 moves away from the base plate 13 of the cable transporter 1 and, after insertion of the cable 21 between the pressure rollers 6, 7, the adjustable plate 20 travels by means of compressed air or by means of the pressure of another mechanical energy accumulator 28, for example of a pneumatic cylinder, or a spring, to a position in which the pressure rollers 6, 7 and the measuring wheel 22 and the counter-wheel 23 press with a defined force onto the cable 21 to be transported. A pressure mechanism 27 controls the pressure on the cable 21 to be transported, by the pressure rollers 7 mounted in a fixed manner on the adjustable plate 20 relative to the pressure rollers 6 mounted on the base plate 13 of the cable transporter 1. Such a non linear pressure mechanism is shown in FIG. 5. The pressure mechanism 27 includes a mechanical energy accumulator 28 or a pneumatic cylinder with recuperating spring 46, which are connected via a displaceably guided connecting part to an eccentric lever 30 displaceably guided on a carriage 29. The lever geometry is chosen so that the pressure likewise decreases with decreasing distance between the pressure rollers 6, 7.

For avoiding forward and return transport of the cable 21 during the pivot movement, the second drive belt sprocket 24, which is responsible for the rotation of the pressure rollers 6, 7 of the cable transporter 1, rotates in the same direction with the first drive belt sprocket 19 of the first drive means 3 via a control. In a further working example according to FIGS. 6 and 7, the pressure rollers 6, 7 are in the form of belt sprockets, two pressure rollers 6 forming a first pressure roller pair 36 and two pressure rollers 7 forming a second pressure roller pair 37, and a first toothed belt 38 being tensioned over the first pressure roller pair 36 and a second toothed belt 39 being tensioned over the second pressure roller pair 37, and the cable being clamped and guided between the first and the second toothed belts 38, 39 and the transport of the cable 21 taking place by means of frictional contact.

Figure 8:
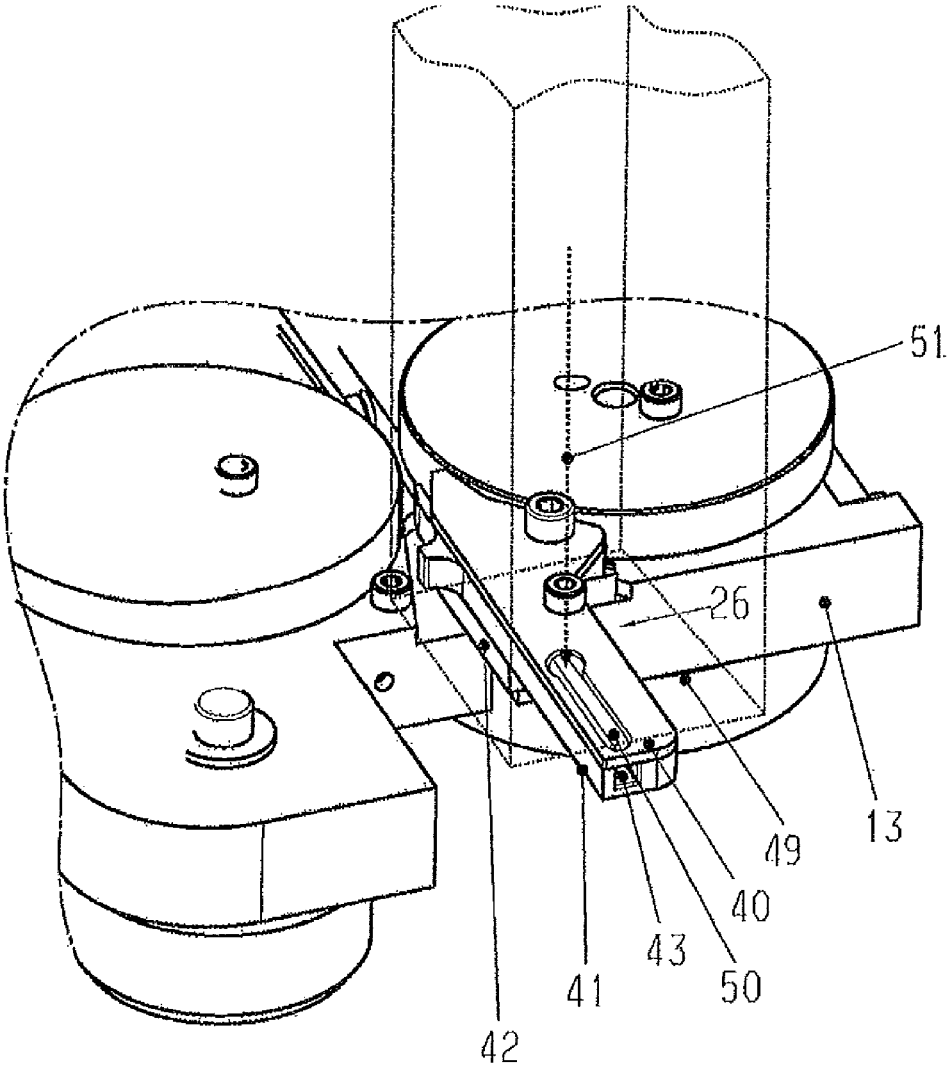
FIG. 8 shows a diagram of a guide sleeve according to the invention in plate design for a cable.
Figure 8A:
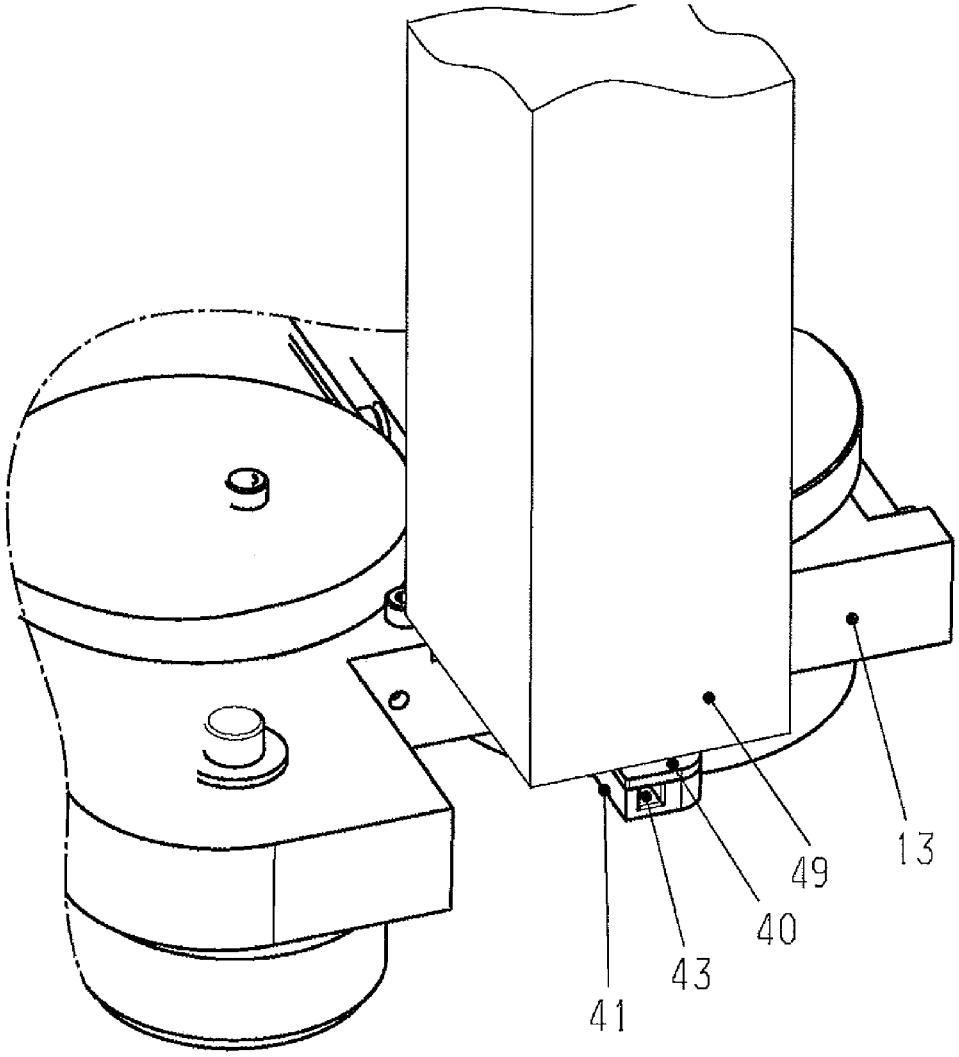
FIG. 8A shows a diagram of a guide sleeve according to the invention in plate design for a cable.

According to FIG. 8, the cable transporter 1 has a guide sleeve 26 for the cable 21. The guide sleeve 26 is composed of a grooved plate 41 and a cover plate 40. These plates can be replaced for adaptation to different cable diameters and for correction of the position of the cable 21 and are equipped for this purpose with different groove geometries.

In addition, the cover plate 40 and/or the grooved plate 41 may have openings 50 which permit a cable inscriber 49, e.g. a printer ink 51, access to the cables 21.

Figure 9:
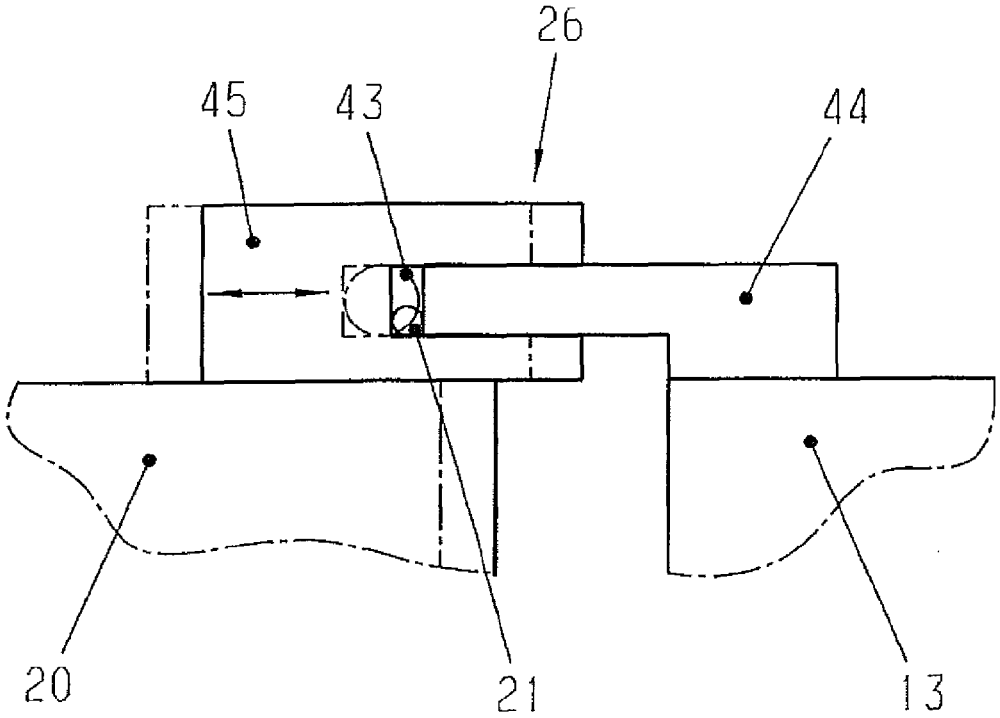
FIG. 9 shows a schematic diagram of a first variant of a divided, adjustable guide sleeve.
Figure 10:
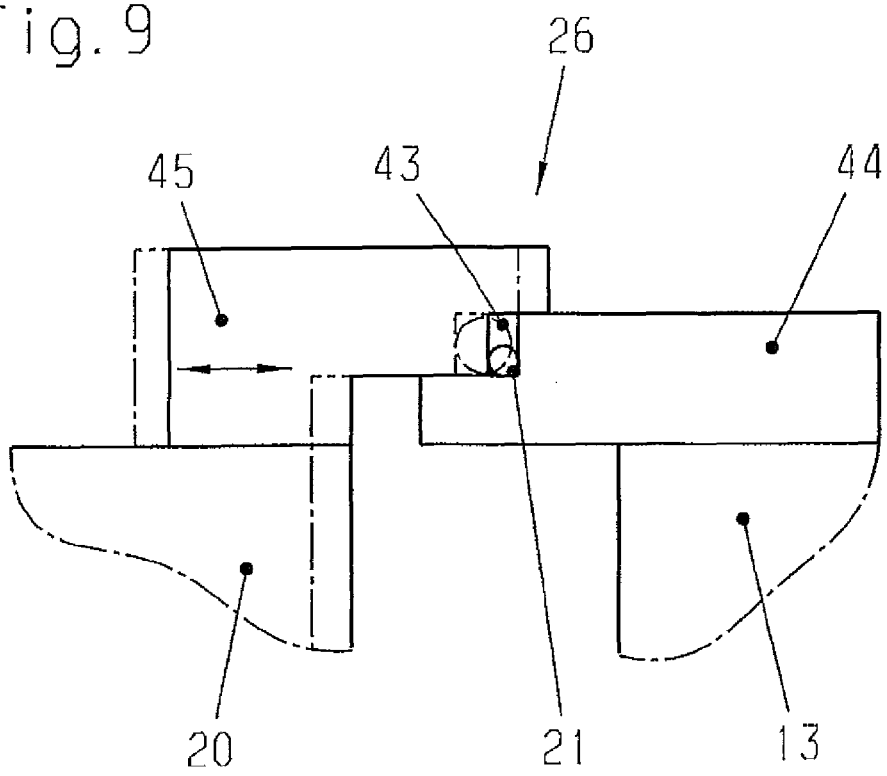
FIG. 10 shows a schematic diagram of a second variant of a divided adjustable guide sleeve.
Figure 11:
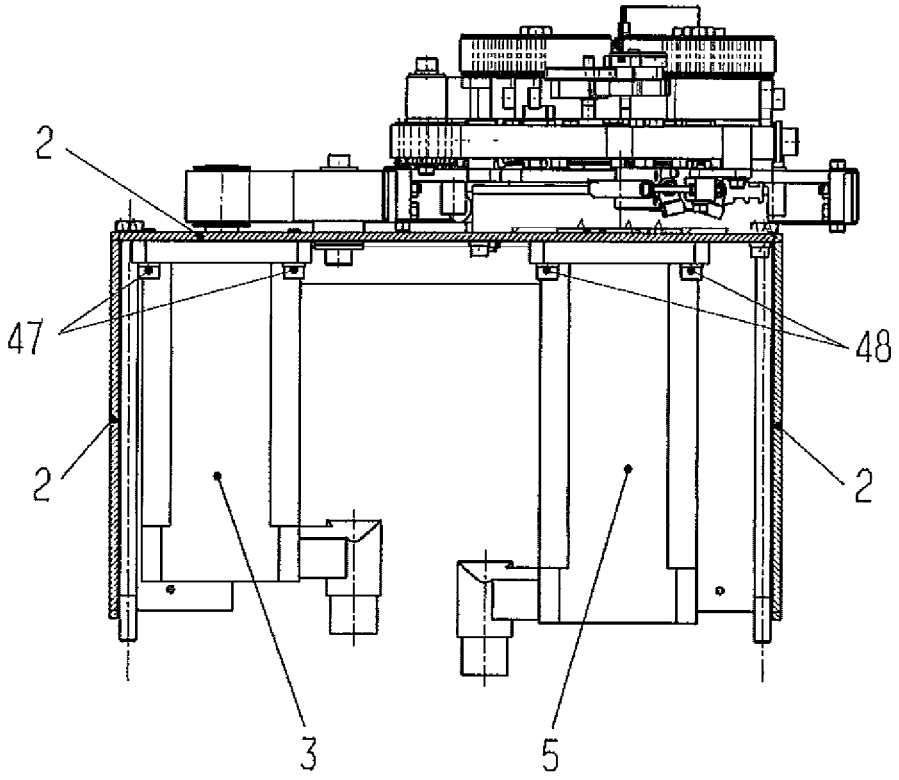
FIG. 11 shows a diagram of a section of a base frame according to the invention.

FIG. 9 and FIG. 10 show that the guide sleeve 26 is formed from two channel elements, a first channel element 44 being fixed to the base plate 13 of the cable transporter 1 and a second channel element 45 being fixed to the adjustable plate 20. A guide channel 43 which is adapted to the respective cable in width is formed by the distance between base plate and adjustable plate, which distance is determined by the cable.

Alternatively, the first channel element 44 is fixed on the adjustable plate 20 and the second channel element 45 is fixed on the base plate 13 of the cable transporter 1.

The adjustable plate 20 and base plate 13 of the cable transporter 1 move relative to one another so that both can also be moved onto the cable 21.

It is within the scope of the invention to use one pressure roller 6, 7 each depending on the cable to be transported and to be processed. More than two pressure rollers 6, 7 each are also conceivable and, under certain conditions, can even replace an upstream orientation station.

It is also within the scope of the invention for the measuring wheel 22 and the counter-wheel 23 to be arranged upstream or downstream of the pressure rollers 6, 7. This will be required in particular in the case of cable transport devices according to FIGS. 6 and/or 7.

It is also within the scope of the invention if a pressure mechanism differing from the disclosure is used.

LIST OF REFERENCE NUMERALS

1—Cable transporter
2—Base frame
3—First drive means
4—Pivot axis
5—Second drive means
6—Pressure rollers, counterclockwise, arranged on the base plate 13
6'—Belt sprocket
7—Pressure rollers, clockwise, arranged on the adjustable plate 20
7'—Belt sprocket
8—Axis of rotation of the pressure rollers 6
9—Axis of rotation of the pressure rollers 7
10—Drive axle of the second drive means 5
11—Semicircular pivot plate
12—Straight lateral surface
13—Base plate of the cable transporter 1
14—First end of the toothed belt 16
15—Second end of the toothed belt 16
16—Toothed belt
17—Deflection belt sprocket
18—First drive axle of the first drive means 3
19—Drive sprocket of the first drive means 3
20—Adjustable plate
21—Cable
22—Measuring wheel
23—Counter-wheel
24—Drive belt sprocket of the second drive means 5
25—Toothed belt
26—Guide sleeve
27—Pressure mechanism
28—Mechanical energy accumulator, e.g. pneumatic cylinder, or spring
29—Carriage
30—Eccentric

31—Pitch axis
32—Toothed belt
33—Center of rotation
34—First intermediate shaft, top
34—Second intermediate shaft, bottom
35—First pressure roller pair
36—Second pressure roller pair
38—First toothed belt
39—Second toothed belt
40—Cover plate
41—Grooved plate
42—Holder
43—Guide channel
44—First channel element
45—Second channel element

What is claimed is:

1. A cable transport machine comprising:

a base frame;

a pivotably mounted cable transporter having a base plate and an adjustable plate;

a first drive motor mounted in stationary mounting on said base frame, said first drive motor being operatively connected to said cable transporter to effect controlled pivot movement of said cable transporter around a pivot axis;

a plurality of pressure rollers operatively supported by said cable transporter, each of said pressure rollers having a respective axis of rotation, said plurality of respective axes of rotation of said pressure rollers being parallel to one another and also parallel to the pivot axis, at least one of said plurality of pressure rollers being laterally adjustable;

a first pair of said plurality of pressure rollers rotatably mounted on said base plate, each of said first pair of pressure rollers having a respective axis of rotation;

a second pair of said plurality of pressure rollers rotatably mounted on said adjustable plate, each of said second pair of pressure rollers having a respective axis of rotation, said second pair of pressure rollers being arranged opposite said first pair of pressure rollers;

a measuring wheel configured to measure cable length by contact with transported cable said measuring wheel disposed between one of said pairs of pressure rollers a second drive motor; and, a drive axle of said second drive motor operatively connected to synchronously drive said plurality of pressure rollers, said drive axle having an axis coincident with the pivot axis around which said cable transporter undergoes controlled pivot movement.

2. A cable transport machine as claimed in claim 1, further comprising:

a motor connected to said adjustable plate to controllably move said adjustable plate between a first position in which it is separated from said base plate sufficiently to permit cable insertion between said first and second pairs of pressure rollers, and a second position in which said first and second pairs of said pressure rollers and said measuring wheel press with a defined force on cable inserted between said first and second pairs of pressure rollers.

3. A cable transport machine as claimed in claim 2, further comprising:

a pressure mechanism configured to control pressure exerted on a cable inserted between said first and second pairs of pressure rollers.

4. A cable transport machine as claimed in claim 3, further comprising:

said pressure mechanism including a spring; and, said pressure mechanism being operatively connected to an eccentric lever geometrically sized to exert decreasing pressure with decreasing separation distance between said first and second pairs of pressure rollers.

5. A cable transport machine as claimed in claim 1, further comprising:

a plurality of belt sprockets, each of said plurality of belt sprockets being operatively connected to a respective associated one of said plurality of pressure rollers, and each of said plurality of belt sprockets having the same respective axis of rotation as its respective associated pressure roller;

a second drive belt sprocket arranged on said drive axle; and, a double-sided toothed belt forming a drive connection among said plurality of belt sprockets and said second drive belt sprocket.

6. A cable transport machine as claimed in claim 5, further comprising:

a first drive belt sprocket connected to said first drive motor, said first drive belt sprocket's rotation during execution of controlled pivot movements being controllably linked to rotation of said second drive belt sprocket, to prohibit forward or backward transport of cable between said first and second pairs of pressure rollers as a consequence of controlled pivot movements.

7. A cable transport machine as claimed in claim 1, wherein each of said pressure rollers of the first pair and the second pair of pressure rollers are in the form of a belt sprocket; wherein the cable transport machine further comprises a first toothed belt tensioned over said first pair of pressure rollers; and, a second toothed belt tensioned over said second pair of pressure rollers, wherein said first and second toothed belts are adapted to clamp, guide, and transport by frictional contact cable between them.

8. A cable transport machine as claimed in claim 1, further comprising:

a guide sleeve on said cable transport device, said guide sleeve including a replaceable grooved plate, and said guide sleeve also including a replaceable cover plate.

9. A cable transport machine as claimed in claim 8, further comprising:

at least one opening in said guide sleeve; and, a cable inscriber configured to access cable through said at least one opening.

10. A cable transport machine as claimed in claim 1, further comprising:

a guide sleeve on said cable transport device, said guide sleeve having a first channel member connected to said base plate, and said guide sleeve having a second channel member connected to said adjustable plate, wherein the distance between said base plate and adjustable plate forms a cable guide channel between said first and second channel members.

11. A cable transport machine as claimed in claim 1, further comprising:

a pivot plate mounted horizontally around the pivot axis, said pivot plate having first and second termini;

said pivot plate connected to said base plate;

a toothed belt segment having first and second ends, said first belt segment end being connected to said first terminus of said pivot plate, said second belt segment end being connected to said second terminus of said pivot plate;

said toothed belt segment passing over a deflection belt sprocket; and, said toothed belt segment passing over a drive belt sprocket, said drive belt sprocket being mounted on a first drive axle of said first drive motor.

12. A cable transport machine comprising:

a base frame;

a pivotably mounted cable transporter;

said pivotably mounted cable transporter having a base plate;

a first drive motor mounted in a stationary mounting on said base frame, said first drive motor being operatively connected to said cable transporter to effect controlled pivot movement of said cable transporter around a pivot axis;

a plurality of pressure rollers operatively supported by said cable transporter, each of said pressure rollers having a respective axis of rotation, said plurality of respective axes of rotation of said pressure rollers being parallel to one another and also parallel to a cable transporter pitch axis, at least one of said plurality of pressure rollers being laterally adjustable;

a first intermediate shaft arranged on said base plate, said first intermediate shaft's axis being coincident with the cable transporter pitch axis;

a second drive motor connected in the stationary mounting to said base frame;

a second intermediate shaft mounted on said base frame and operatively connected to be driven by said second drive motor; and, a first toothed belt tensioned between said first and second intermediate shafts symmetrically to a center of rotation located on the pivot axis of said cable transporter, said first toothed belt transmitting drive movement from said second drive motor to said plurality of pressure rollers.

13. A cable transport machine as claimed in claim 12, further comprising:

a first pair of said plurality of pressure rollers being rotatably mounted on said base plate, each of said first pair of pressure rollers having a respective axis of rotation;

said cable transporter having an adjustable plate;

a second pair of said plurality of pressure rollers being rotatably mounted on said adjustable plate, each of said second pair of pressure rollers having a respective axis of rotation, said second pair of pressure rollers being arranged opposite said first pair of pressure rollers; and, a measuring wheel configured to measure cable length by contact with transported cable, said measuring wheel disposed between one of said pairs of pressure rollers.

14. A cable transport machine as claimed in claim 13, further comprising:

a motor connected to said adjustable plate to controllably move said adjustable plate between a first position in which it is separated from said base plate sufficiently to permit cable insertion between said first and second pairs of pressure rollers, and a second position in which said first and second pairs of said pressure rollers and said measuring wheel press with a defined force on cable inserted between said first and second pairs of pressure rollers.

15. A cable transport machine as claimed in claim 14, wherein the motor is part of a pressure mechanism configured to control pressure exerted on a cable inserted between said first and second pairs of pressure rollers.

16. A cable transport machine as claimed in claim 15, further comprising:

said pressure mechanism including a spring; and, said pressure mechanism being operatively connected to an eccentric lever the geometry of which is chosen to exert decreasing pressure with decreasing separation distance between said first and second pairs of pressure rollers.

17. A cable transport machine as claimed in claim 12, further comprising:

a plurality of belt sprockets, each of said belt sprockets being operatively connected to a respective associated one of said plurality of pressure rollers, and each of said belt sprockets having the same respective axis of rotation as its respective associated pressure roller;

a second drive belt sprocket arranged on said first intermediate shaft; and, a double-sided toothed belt forming a drive connection among said plurality of belt sprockets and said second drive belt sprocket.

18. A cable transport machine as claimed in claim 12, further comprising:

said plurality of pressure rollers includes a first pair and a second pair of pressure rollers, each of said pressure rollers of said first and second pairs being in the form of a belt sprocket;

a first toothed belt tensioned over said first pair of pressure rollers; and, a second toothed belt tensioned over said second pair of pressure rollers, wherein said first and second toothed belts are adapted to clamp, guide, and transport by frictional contact cable between them.

19. A cable transport machine as claimed in claim 12, further comprising:

a guide sleeve on said cable transport device, said guide sleeve including a replaceable grooved plate, and said guide sleeve also including a replaceable cover plate.

20. A cable transport machine as claimed in claim 19, further comprising: at least one opening in said guide sleeve; and, a cable inscriber configured to access cable through said at least one opening.

21. A cable transport machine as claimed in claim 12, further comprising:

said cable transporter having an adjustable plate; and, a guide sleeve on said cable transport device, said guide sleeve having a first channel member connected to said base plate, and said guide sleeve having a second channel member connected to said adjustable plate, wherein the distance between said base plate and adjustable plate forms a cable guide channel between said first and second channel members.

22. A cable transport machine as claimed in claim 12, further comprising:

said cable transporter having an adjustable plate;

a pivot plate mounted horizontally around the pivot axis, said pivot plate having first and second termini;

said pivot plate connected to said base plate;

a toothed belt segment having first and second ends, said first belt segment end being connected to said first terminus of said pivot plate, said second belt segment end being connected to said second terminus of said pivot plate;

said toothed belt segment passing over a deflection belt sprocket; and, said toothed belt segment passing over a drive belt sprocket, said drive belt sprocket being mounted on a first drive axle of said first drive motor.

23. The cable transport machine as claimed in claim 22, wherein:

said cable transporter's pitch axis intersects said cable transporter's pivot axis.

* * * * *